US006783015B1

(12) United States Patent
Bösl et al.

(10) Patent No.: US 6,783,015 B1
(45) Date of Patent: Aug. 31, 2004

(54) CLOSURE CAP

(75) Inventors: Udo Bösl, Eimeldingen (DE); Georg Pfefferkorn, Müllheim (DE)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/787,047

(22) PCT Filed: Aug. 14, 1999

(86) PCT No.: PCT/EP99/05971

§ 371 (c)(1),
(2), (4) Date: May 7, 2001

(87) PCT Pub. No.: WO00/15504

PCT Pub. Date: Mar. 23, 2000

(30) Foreign Application Priority Data

Sep. 14, 1998 (EP) ..... 98810912

(51) Int. Cl.[7] ..... B65D 53/00
(52) U.S. Cl. ..... 215/349; 215/307; 215/350
(58) Field of Search ..... 215/307, 349, 215/350, 351

(56) References Cited

U.S. PATENT DOCUMENTS

| | | | | | |
|---|---|---|---|---|---|
| 2,032,931 | A | * | 3/1936 | Gibbs | 215/260 |
| 2,804,225 | A | * | 8/1957 | Lee | 215/262 |
| 4,036,386 | A | * | 7/1977 | Nishioka et al. | 215/260 |
| 4,076,152 | A | * | 2/1978 | Mumford | 215/321 |
| 4,346,812 | A | * | 8/1982 | Banich, Sr. | 215/352 |
| 4,560,077 | A | | 12/1985 | Dutt | |
| 4,598,835 | A | * | 7/1986 | Brownbill | 215/307 |
| 4,629,083 | A | | 12/1986 | Druitt | |
| 5,062,538 | A | * | 11/1991 | Ochs | 215/260 |
| 5,078,290 | A | * | 1/1992 | Ochs | 215/252 |
| 5,356,021 | A | * | 10/1994 | McBride et al. | 215/349 |
| 5,743,420 | A | * | 4/1998 | Loffler et al. | 215/270 |
| 5,785,196 | A | * | 7/1998 | Montgomery | 215/270 |
| 5,924,586 | A | * | 7/1999 | Gregory et al. | 215/350 |
| 6,202,871 | B1 | * | 3/2001 | Kelly | 215/307 |
| 6,276,543 | B1 | * | 8/2001 | German et al. | 215/252 |
| 6,477,823 | B1 | * | 11/2002 | Kitterman et al. | 53/485 |
| 6,502,710 | B1 | * | 1/2003 | Bosl et al. | 215/351 |

FOREIGN PATENT DOCUMENTS

| | | | | |
|---|---|---|---|---|
| DE | 43 01 306 A1 | | 7/1994 | |
| EP | 0 055 916 A1 | | 7/1982 | |
| EP | 0 370 272 A1 | | 5/1990 | |
| EP | 0 661 218 A1 | | 7/1995 | |
| EP | 0 770 559 A1 | | 5/1997 | |
| FR | 851.275 | * | 1/1940 | 215/349 |

* cited by examiner

*Primary Examiner*—Jes F. Pascua
(74) *Attorney, Agent, or Firm*—Woodcock Washburn LLP

(57) ABSTRACT

A closure cap comprises in a transition range (7) between the cap base (2) and the cap skirt (3) a bulge (6) for pressing a sealing disk (5) against a container opening. The bulge (6) comprises an undercut (8) and in sections (9) is provided with weakenings (10) which give the bulge (6) a radial flexibility.

29 Claims, 3 Drawing Sheets

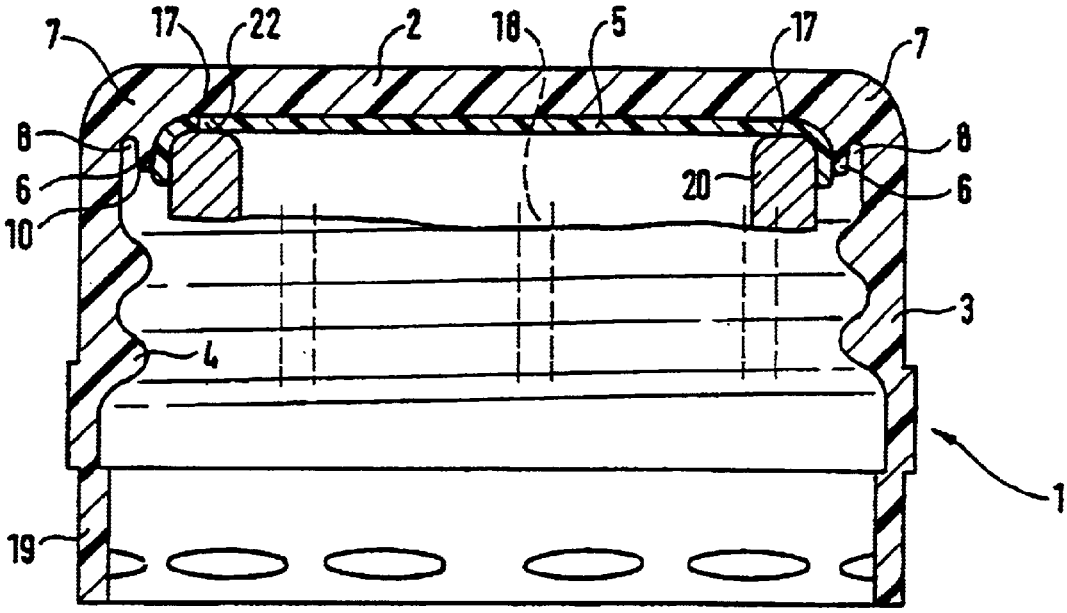
FIG. 1
FIG. 2
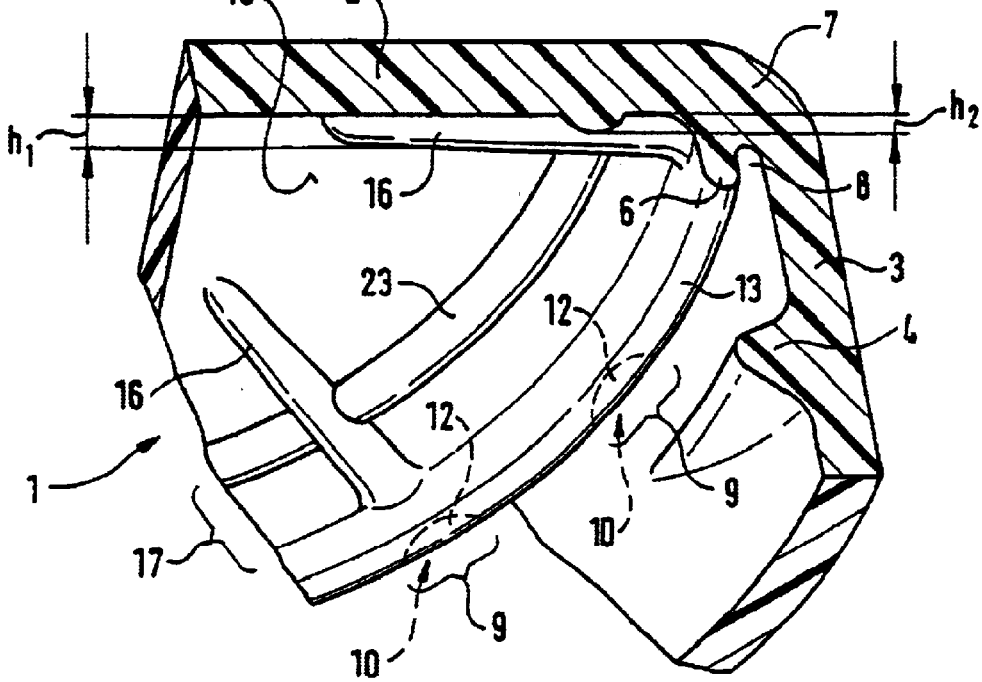

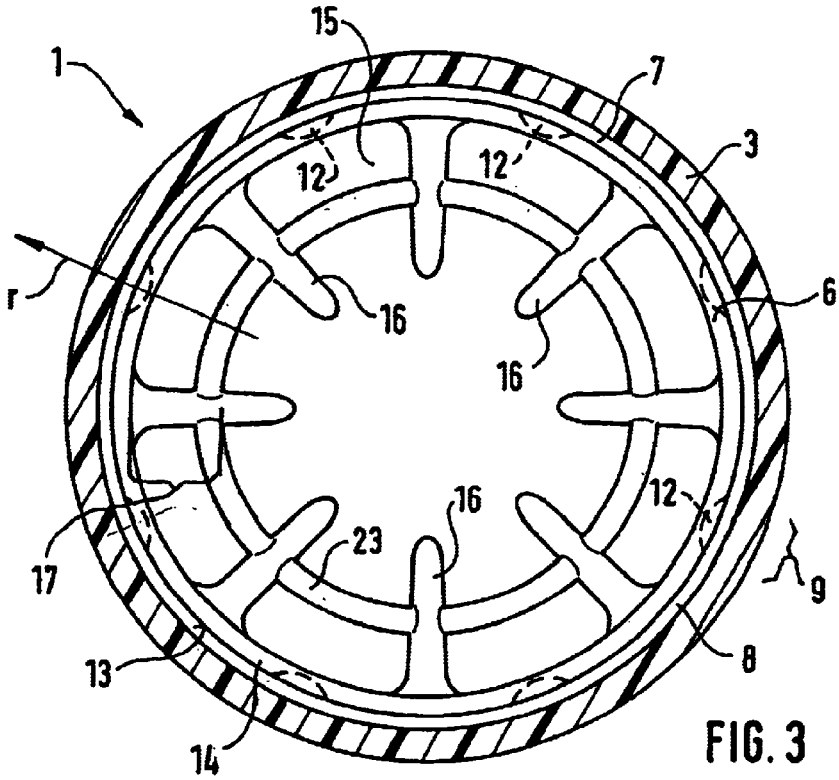
FIG. 3
FIG. 4a
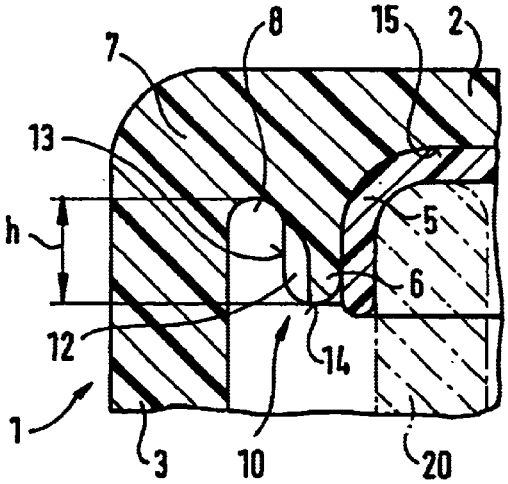
FIG. 4b
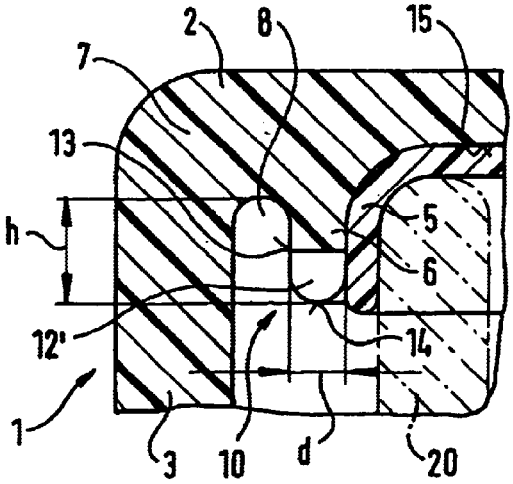

CLOSURE CAP

BACKGROUND OF THE INVENTION

The invention relates to a closure cap with the features of the preamble of the independent patent claims. Such closures of plastic are known in a multitude and are used for closing amongst other things also containers with carbonated beverages.

With this many various arrangements for achieving a sealing between the sealing cap and the container opening are known. With a known sealing variant the sealing is achieved by a sealing disk which is layed onto the inner side of the cap base and which by the cap base is pressed against the container opening.

It is important that above all in the region of the outer edge of the container opening, a good pressing-on of the sealing disk is achieved.

From EP 55 916 there is known such a closure. The sealing disk by way of a projection in the region between the cap base and the cap skirt is pressed against the upper outer edge of the opening of the container in a specific manner. In this manner a pressing with a high surface pressure and thus a good sealing effect is achieved.

If in the inside of the bottle there is formed an excess pressure for example by way of fermentation or heating, there exists the danger that the container breaks or that the closure cap jumps off. There have already been various attempts to solve this problem.

From EP 370 272 it is for example known to partly interrupt the circumferential rib for pressing the sealing disk. The sealing disk may in the region of the interruptions escape given an excess pressure and thus permit a reduction of the pressure in the container. The construction according to EP 370 272 is however burdened by the disadvantage that in the regions of the interruption the sealing disk may not at all be pressed onto the outer edge. This may lead to leakage even when in the container no excess pressure is to be found.

From U.S. Pat. No. 4,629,083 and from EP 770 559 there is furthermore known a closure cap in which the bulge which is to press the sealing disk against container neck is not arranged as a thickening in the transition region between the cap base and the cap skirt, but as a circumferential lip projecting axially downwards. With this design there exists the problem that the pressing on account of the gap between the rib and the inner side of the cap skirt is not very strong. These two designs likewise do not solve the problem of the bursting of the container with an increased inner pressure.

It is therefore the object of the present invention to avoid the disadvantages of the known, in particular thus to provide a closure cap which with an increased inner pressure in the container functions in the manner of a safety valve, i.e. permits a gas escape, which however reliably seals with a normal inner pressure and which is simply and economically manufacturable.

SUMMARY OF THE INVENTION

According to the invention, these objects are achieved with a closure cap comprising a cap base, a cap skirt with inner retaining elements which may be brought into engagement with outer retaining means of an opening of the container, a sealing disk which at least partly bears on the cap base, and a circumferential bulge arranged in a transition region between said cap base and said cap skirt for pressing said sealing disk onto an upper outer edge of said opening of the container. The closure gap between the bulge and the skirt at least partly may be provided with a circumferential undercut. The bulge in at least one segment-like section may have a weakening such that the weakenings facilitate relief of over-pressure within the container.

The closure cap for a container comprises a cap base and a cap skirt. The cap skirt is provided with retaining means which may be brought into engagement with outer retaining means on the opening of a container. The cap may for example also comprise a snap or bayonette thread. The cap can advantageously be applied with carbonated beverages or with beverages which are filled hot.

The closure cap furthermore comprises a sealing disk which at least partly bears on the cap base. Of course also a sealing inlay which does not pass through, for example a sealing ring is conceivable. The closure cap furthermore comprises in the transition region between the cap base and the cap skirt a circumferential bulge for pressing the sealing disk onto the upper outer edge of the opening of the container. The closure cap between the bulge and the skirt is provided at least partly with a circumferential undercut. The undercut may extend uniformly over 360 degrees over the circumference of the closure cap.

It is however also conceivable to form the undercut only in segments. The bulge is furthermore in at least one segment-shaped section provided with a weakening. The combination of a circumferential bulge with an undercut and with a weakening in segment-like sections leads to a particularly good sealing effect which however permits the venting of an excess pressure.

Because the bulge circumferentially is formed without interruptions in the transition region between the cap base and the cap skirt, a uniform pressing of the sealing disk onto the container opening is effected. The undercut gives the lower edge of the bulge a certain flexibility so that the bulge on impinging with pressure is bendable outwards. By way of the selection of the size of the undercut the pressure at which the inner pressure is vented may be exactly predetermined. The weakenings in the bulge give the bulge in the predetermined sections a larger radial flexibility. In these section the sealing disk with an inreased inner pressure may be pressed outwards. Venting is thus possible.

Preferably the undercut extends from the lower edge of the bulge into a region which has a distance to the cap base. This means that the bulge in the transition region between the cap base and the cap wall is formed continuously.

In a particularly preferred embodiment example the weakening of the bulge is formed by weakenings on the outer side of the bulge, which faces the cap skirt. With this segment-like weakenings are produced without there resulting an irregular pressing surface. The pressing surface which presses the sealing disk against the outer upper edge of the container opening thus extends over 360° and is essentially flat, i.e. it has no deepenings or elevations. The deepenings on the outer side of the bulge however also give the bulge an increased radial flexibility in predeterminable regions.

Of course it is also conceivable to provide other types of weakenings. For example the bead may be weakened by another material selection, another orientation of the material or by another thickness of the material.

In an alternative embodiment example the weakening of the bulge is formed by weakenings which from the lower end of the bulge extend axially against the cap base and which preferably extend over the whole thickness of the bulge. Since the deepenings do not extend up to the upper end of the bulge but only towards the cap base, the disadvantages of a bulge with continuous interruptions according to the state of the art are avoided.

The weakening extends advantageously substantially over the height of the undercut. In the region between the lower end of the bulge and the end of the undercut the bulge is flexible. In this region the weakening is particularly effective.

The sections which comprises weakenings of the bulge comprise preferably as a whole (i.e. the sum of all sections together) an angular range of 90° to 220°. With this preferably about 3 to 15 sections are provided with weakenings.

For increasing the venting function the cap base on its inner side may furthermore be provided with at least one radial deepening which extends radially over a sealing section of the cap base. The sealing section defines that zone of the cap base which presses the sealing disk against the container opening. On account of the deepening in the cap base the sealing disk may be forced axially upwards and thus form a path for reduction of an excess pressure. In a particularly preferred embodiment example the radial deepening in the radial seal is flush with a weakening of the bulge.

In a further embodiment example the cap base on its inner side is provided with a circumferential rib which runs concentrically to the closure cap. The circumferential rib serves for increasing the pressing force of the sealing disk. Furthermore also radially running ribs may be provided on the cap base. The radial ribs are preferably formed higher than the circumferential rib. In this case the radial deepenings are done away with. It has been ascertained that the provision of such radial ribs above all is advantageous with hot fillings, for example with fruit juices. On account of the heat with this the sealing disk becomes softer and there usually exists the danger that the sealing disk is pulled axially inwards. With the radial ribs and with the circumferential rib this is avoided.

BRIEF DESCRIPTION OF THE FIGURES

The invention is hereinafter described in more detail in embodiment examples and by way of the drawings. There are shown:

FIG. 1 a cross section through a closure cap according to the invention,

FIG. 2 a schematic perspective representation of a cutout of the closure cap according to the invention, FIG. 3 a view from below of a closure cap according to the invention, without a sealing disk, FIGS. 4*a* and 4*b* two embodiment examples of the weakening of the bulge, and FIG. 5 a closure cap according to FIG. 4*a* on a container with an increased inner pressure.

DETAILED DESCRIPTION OF PREFERRED EMBODIMENTS

Figure 5:
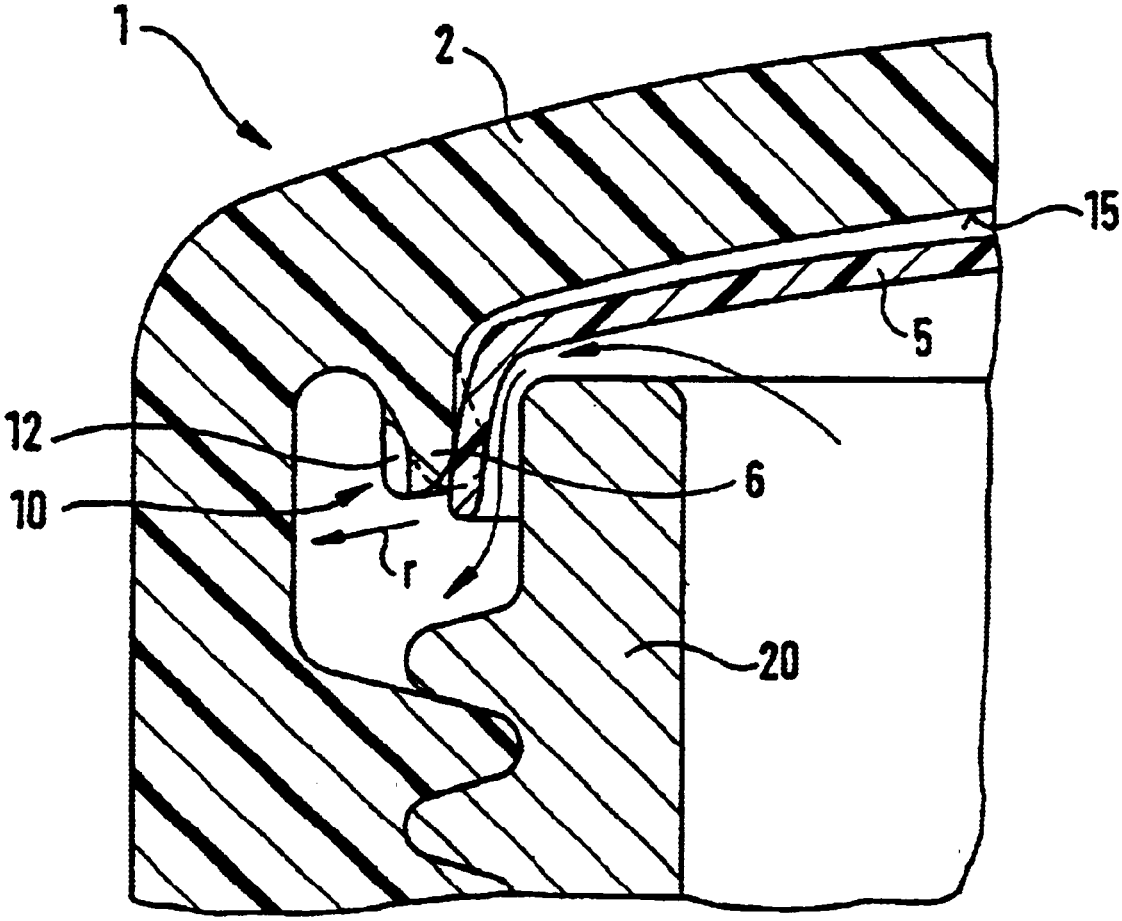

FIG. 1 shows a closure cap 1 according to the invention in cross section. The closure cap 1 consists essentially of a cap base 2 and of a cap skirt 3 which meet one another in a transition region 7. The closure cap 1 is provided with an applied sealing disk 5 which bears on the inner side of the cap base 2. The sealing disk serves for sealing a container opening of a schematically shown container 20.

In the transition region 7 there is provided a bulge 6 which presses the sealing disk 5 against the upper edge 22 of the container 20.

Between the bulge 6 and the inner side of the cap skirt 3 there is provided an undercut 8 which gives the lower end 14 (see FIGS. 3 and 4) an increased radial flexibility. According to the invention the bulge 6 in the region of the undercut 8 is provided with weakenings 10. The weakenings 10 give the bulge 6 in selected sections 9 (see FIGS. 2 to 4) an additional increased radial flexibility.

The sealing disk 5 in a sealing region 17 is pressed by the cap base 2 onto the container opening. As soon as in the inside of the container an increased inner pressure arises the cap base 2 is pressed upwards by which means the sealing disk in the sealing section 17 is relieved of pressure. On account of the weakenings in the bulge 6 the sealing disk 5 in the region of the sections 9 with weakenings may be pressed radially outwards and the increased inner pressure is reduced.

The closure cap may furthermore be provided with further design details known for closure caps. In FIG. 1 there is shown a tamper evident strip 19 which is to indicate any unauthorised opening of the closure. Furthermore the closure cap is provided with venting recesses 18 which favour the venting of gas.

In FIG. 2 there is perspectively shown a cutout of the closure cap 1 according to the invention without a sealing disk. In FIG. 2 the segment-like sections 9 can be recognised in which the bulge 6 is provided with weakenings 10. The weakenings 10 are formed as deepenings 12 which are arranged on the outer side 13 of the bulge 6.

Together with the undercut 8 the deepenings 12 lead to a radial flexibilisation of the bulge 6.

The inner side 15 of the cap base 2 is furthermore provided with radial ribs 16. The radial ribs 16 extend essentially over the sealing section 17 in which a sealing disk 5 (see FIG. 1) can be pressed against a container opening. The cap base 2 is furthermore provided with a circumferential rib 23 which increases the pressing of the sealing disk 5 in the region outside the radial deepenings 16. The height $h_1$ of the radial ribs 16 is larger than the height $h_2$ of the circumferential rib 23.

In FIG. 3 a closure cap according to the invention without a sealing disk is shown from below. The circumferential bulge 6 comprises a continuous inner side. On the outer side 13 of the bulge 6, which is directed against the cap skirt 3, the bulge 6 is provided with deepenings 12. The deepenings 12 lead to weakenings of the bulge 6 in segment-like sections 9. The deepenings 12 are uniformly distributed over the whole circumference of the closure cap. They extend in each case over an angular range of about 5° to 40°. Furthermore radial ribs 16 are shown in the cap base 2, which end between the deepenings 12. On the inner side of the cap base 2 there is furthermore shown a circumferential rib 23 which in the sealing section 17 presses the non-shown sealing disk 5 against the container opening. The undercut 8 between the cap skirt 3 and the bulge 6 gives the bulge in combination with the deepenings 12 an increased flexibility in the arrow direction r.

In FIGS. 4*a* and 4*b* there are shown various embodiment examples for forming the weakenings 10 of the bulge 6.

In FIG. 4*a* the bulge 6 is only provided with a deepening 12 on the outer side 13 which is directed against the cap skirt 2. The deepening 12 extends from the lower end 14 axially towards the cap base 2. The undercut 8 has a height h. The end of the undercut 8 lies at a distance to the inner side 15 of the cap base 3. This means that the bulge 6 in the transition region 7 between the cap skirt 2 and the cap base 3 is formed continuously between the cap base and the cap skirt. The sealing disk 5 is pressed by the bulge 6 against an only schematically represented opening of a container 20.

In FIG. 4*b* there is shown an alternative embodiment example of the invention. The deepening 12' which forms the weakening in the bulge is formed continuous in the radial direction. Otherwise the embodiment example according to FIG. 4*b* corresponds to the example from FIG. 4*a*.

In FIG. 5 the embodiment example according to FIG. 4*a* is shown on a container with an increased inner pressure. On account of the increased pressure in the container 20 the cap base 2 is curved axially outwards (so-called doming). By way of this the sealing disk 5 in the sealing section 17 is relieved of pressure so that gas may escape. On account of the weakening 10 of the bulge 6, the bulge and with this the sealing disk 5 may be pressed radially outwards in the arrow direction r, by which means gas may escape also in this region. In dashed lines the position of the bulge in the normal situation is shown. In the circumferential sections outside the sections 9 with weakenings 10 the bulge 6 assumes this original situation. The venting is thus effected only in segments and is therefore exactly controllable. In the remaining sections the pressing of the sealing disk 5 as previously is so large that a sealing is ensured.

What is claimed is:

1. A closure cap for a container, comprising a cap base, a cap skirt, with inner retaining elements which may be brought into engagement with outer retaining means of an opening of the container;

a sealing disk which at least partly bears on the cap base and a circumferential bulge arranged in a transition region between said cap base and said cap skirt, for pressing said sealing disk onto an upper outer edge of said opening of the container, wherein said sealing disk bears at a radially inner surface of said circumferential bulge, wherein the closure cap between said bulge and said skirt at least partly is provided with a circumferential undercut having a height, and wherein said bulge in at least one segment-like section has a weakening, and wherein said weakening does not extend the full height of said undercut.

2. A closure cap according to claim 1, wherein the undercut extends into a region which is distanced to an inner side of the cap base.

3. A closure cap according to claim 1, wherein the weakening of said bulge is formed by deepenings on an outer side of said bulge facing the cap skirt.

4. A closure cap according to claim 1, wherein said weakening of said bulge is formed by deepenings which extend from a lower said bulge axially towards said cap base.

5. A closure cap according to claim 4, wherein said deepenings extend over the whole thickness of the bulge.

6. A closure cap according to claim 1, wherein said undercut has a height and wherein the weakenings extend substantially as far as said height of said undercut.

7. A closure cap according to claim 1, wherein the sections having a weakening extend together over an angular range of 90° to 220°.

8. A closure cap according to claim 1, wherein said cap base on an inner side has at least one radial rib which radially extends at least over a sealing section of the cap base.

9. A closure cap according to claim 8, wherein the radial rib ends between neighboring weakenings of the bulge.

10. A closure cap according to claim 8, wherein the cap base has a circumferential rib, wherein the radial rib has a height which is larger than the height of the circumferential rib.

11. A closure cap according to claim 1, wherein the closure cap has three to fifteen sections with a weakening.

12. A closure cap according to claim 1, wherein the bulge is connected to the transition region.

13. A closure cap according to claim 1, wherein the bulge retains said sealing disk even after removal of said closure cap from the container.

14. A combination of a closure cap and a container having an opening, said closure cap comprising a cap base, a cap skirt, with inner retaining elements which may be brought into engagement with outer retaining means of the opening of the container;

a sealing disk which at least partly bears on the cap base and a circumferential bulge arranged in a transition region between said cap base and said cap skirt, for pressing said sealing disk onto an outer upper edge of said opening of the container, an inner diameter of said bulge being larger than the diameter of the outer upper edge of said opening of the container, wherein the closure cap between said bulge and said skirt at least partly is provided with a circumferential undercut having height, and wherein said bulge in at least one segment-like section has a weakening, and wherein said weakening does not extend the full height of said undercut.

15. A combination according to claim 14, wherein the undercut extends into a region which is distanced to an inner side of the cap base.

16. A combination according to claim 14, wherein the weakening of said bulge is formed by deepenings on an outer side of said bulge facing the cap skirt.

17. A combination according to claim 14, wherein said weakening of said bulge is formed by deepenings which extend from a lower said bulge axially towards said cap base.

18. A combination according to claim 17, wherein said deepenings extend over the whole thickness of the bulge.

19. A combination according to claim 14, wherein said undercut has a height and wherein the weakenings extend substantially as far as said height of said undercut.

20. A combination according to claim 14, wherein the sections having a weakening extend together over an angular range of 90° to 220°.

21. A combination according to claim 14, wherein said cap base on an inner side has at least one radial rib which radially extends at least over a sealing section of the cap base.

22. A combination according to claim 21, wherein the radial rib ends between neighboring weakenings of the bulge.

23. A combination according to claim 21, wherein the cap base has a circumferential rib, wherein the radial rib has a height which is larger than the height of the circumferential rib.

24. A combination according to claim 14, wherein the closure cap has three to fifteen sections with a weakening.

25. A combination according to claim 14, wherein the bulge is connected to the transition region.

26. A combination according to claim 14, wherein said sealing disk bears at a radially inner surface of said circumferential bulge.

27. A combination according to claim 14, wherein the bulge retains said sealing disk even after removal of said closure cap from the container.

28. A closure cap for a container, comprising a cap base, a cap skirt, with inner retaining elements which may be brought into engagement with outer retaining means of an opening of the container;

a sealing disk which at least partly bears on the cap base and a circumferential bulge arranged in a transition region between said cap base and said cap skirt, for pressing said sealing disk onto an upper outer edge of said opening of the container, wherein said sealing disk bears at a radially inner surface of said circumferential bulge, wherein the closure cap between said bulge and said skirt at least partly is provided with a circumferential undercut, and wherein said bulge in at least one segment-like section has a weakening, wherein the radial rib ends between neighboring weakenings of the bulge.

29. A closure cap according to claim 28, wherein, wherein said weakening does not extend up to an upper end of said undercut.

* * * * *